US006276091B1

(12) United States Patent
Ridgway

(10) Patent No.: US 6,276,091 B1
(45) **Date of Patent: *Aug. 21, 2001**

(54) SLIDING GLASS DOOR ASSEMBLY HAVING GLASS DOORS WHICH ARE LOCKABLE TOGETHER TO SLIDE AS A UNIT

(76) Inventor: Jaime Carl Ridgway, 5602 Dakota Dr., West Des Moines, IA (US) 50266

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/154,883

(22) Filed: Sep. 17, 1998

(51) Int. Cl.[7] ..... E06B 3/32; E06B 3/46; E05B 55/00

(52) U.S. Cl. ..... 49/125; 49/413; 49/449

(58) Field of Search ..... 49/125, 142, 98, 49/95, 68, 413, 404, 449; 160/90, 91, 89; 292/DIG. 46

(56) References Cited

U.S. PATENT DOCUMENTS

| | | | | |
|---|---|---|---|---|
| 2,553,738 | * | 5/1951 | Anderson | 49/98 |
| 2,870,882 | * | 1/1959 | Tolman | 49/457 |
| 2,950,756 | * | 8/1960 | Moloney | 160/91 |
| 3,110,935 | | 11/1963 | Riegelman . | |
| 3,172,145 | | 3/1965 | Miller . | |
| 3,710,839 | | 1/1973 | Andres . | |
| 3,779,588 | * | 12/1973 | Raymon | 292/DIG. 46 |
| 4,073,517 | * | 2/1978 | Bills | 292/DIG. 46 |
| 4,268,074 | * | 5/1981 | Alexander | 292/DIG. 46 |
| 4,478,267 | | 10/1984 | Smiley . | |
| 4,838,332 | | 6/1989 | Mlenck . | |
| 5,105,868 | | 4/1992 | Riise . | |
| 5,209,018 | * | 5/1993 | Heinrich | 49/449 |
| 5,331,766 | * | 7/1994 | Bennett | 49/449 |
| 5,368,346 | * | 11/1994 | Foster | 292/175 |
| 5,437,115 | * | 8/1995 | Freese et al. | 49/465 |
| 5,598,665 | * | 2/1997 | Guddas | 49/404 |

* cited by examiner

*Primary Examiner*—Gregory J. Strimbu
(74) *Attorney, Agent, or Firm*—Brian J. Laurenzo; Michael C. Gilchrist

(57) ABSTRACT

An assembly for use in a generally rectangular sliding doorway. The assembly includes two sliding glass doors and a stationary screen that are provided in the doorway. The sliding glass doors can be slid within the doorway to allow access across the doorway, to seal the doorway, or to permit ventilation across the doorway through the screen. The assembly also includes a coupling rod provided in a frame of one of the sliding glass doors to be selectively extended into a frame of the other sliding glass door. The sliding glass doors can be locked together to slide as a unit in a fixed relation to each other. The sliding glass doors can also be locked together to lock the sliding glass doors in a closed position to seal the doorway. The same coupling rod serves to lock the sliding glass doors together in the position where they slide together as a unit and in the closed position. The assembly is fully adjustable to be configured with the screen on the right or left side of the doorway. In standard usage, the glass doors will slide to open and close the doorway, but the screen will remain stationary.

3 Claims, 6 Drawing Sheets

SLIDING GLASS DOOR ASSEMBLY HAVING GLASS DOORS WHICH ARE LOCKABLE TOGETHER TO SLIDE AS A UNIT

TECHNICAL FIELD

This invention relates generally to sliding doors, and in particular to an assembly that utilizes two sliding glass doors and a stationary screen.

BACKGROUND OF THE INVENTION

A sliding glass door in combination with a sliding screen door are commonly used to provide access to and from houses and other buildings. They provide greater sunlight and view than a standard swinging door, without the dangers that might be associated with a glass door that swings open. Furthermore, objects may be placed close to the sliding door without need to leave a path for the door to swing open. In the standard arrangement, there are two glass components and a single screen component all contained within a doorframe. Each of the glass components comprises a rectangular frame, typically made of wood, steel, aluminum, or vinyl, which surrounds a glass pane. The screen component comprises a rectangular frame across which a mesh screen is stretched. One of the glass components is stationary and forms a seal at one end of the doorframe, while the other can slide back and forth within the doorframe. The screen also slides back and forth within the doorframe.

This standard arrangement has a fully closed position to prevent access through the doorframe and to prevent natural ventilation across the doorframe. In this fully closed position the sliding glass component is slid to the opposite end of the doorframe from the stationary component. The frames of the glass components form a seal to prevent drafts, water, or insects from crossing the doorframe. When it is desired to have natural ventilation, while still maintaining a barrier to insects, birds, and the like, the sliding glass component is slid within the door frame towards the same end as the stationary component. The screen component is adjusted so that it is slid to the opposite end from the stationary glass component. In this arrangement, ventilation across the screen is allowed, while the screen provides a barrier to insects, small animals, and the like. In order to go in or out of the doorway, the screen must be slid back and forth.

The sliding glass component and the screen are retained in the doorframe by standard trackways. One of the common problems with this standard arrangement is that the screen becomes untracked easily. When this happens it is difficult to move the screen and it is necessary to fix the screen so that it is back in proper engagement with the track. However, getting the screen back into proper engagement with the track can be difficult and frustrating. As a result of its weight and rigidity, the sliding glass component is generally very reliable and rarely becomes untracked.

Another difficulty with standard sliding doorway designs is that the mechanism for locking the doors closed tends to be easily defeated. For this reason, it is common to wedge a broomstick, or other elongated rigid item, between the rear of the sliding glass door and the door frame to prevent the door from being opened. For this reason it would be beneficial to provide a secondary locking mechanism integrated with the door that would reinforce the standard locking mechanism.

In certain instances it would be desirable to change the side of the doorway that is being used for entrance and exit. For this reason it would be advantageous to have a sliding glass door system that is capable of quick conversion between left-hand and right-hand orientation.

The difficulties encountered in the prior art and discussed above are substantially eliminated by the present invention.

SUMMARY OF INVENTION

Accordingly, it is an object of the present invention to provide a sliding glass door entryway in which the screen remains stationary and the glass components are both slidable.

It is another object of the present invention that is more reliable than past sliding glass door entryways.

By the present invention it is proposed to overcome the difficulties encountered heretofore. To that end, a sliding door assembly is proposed for connection within a standard sliding door doorway or the type having a lower frame member, an upper frame member, and first and second vertical frame members at opposite ends of the upper and lower doorway frame members. The doorway is located between an inside area and outside area. The sliding door assembly has first and second glass doors slidably received by the upper and lower frame members of the doorway, the second glass door being located to the outside of the first glass door. A screen panel is operably received by the upper and lower frame members of the doorway and is located to the outside of the first and second glass doors. The assembly includes means for locking the screen panel in place against the first vertical frame member of the doorway such that when the glass doors are slid against the second vertical frame member the screen panel in combination with the glass doors form a barrier to prevent insects and the like from crossing the doorway but still allow ventilation between the inside area and the outside area across the screen panel. When the screen panel is locked in place against the first vertical frame member, and one of the glass doors is against first vertical frame member and the other glass door is against the second vertical frame member, the glass doors form a barrier that substantially prevents ventilation across the doorway. When the screen panel is locked in place against the first vertical frame member of the doorway and both glass doors are slid toward the first vertical frame member of the doorway, an opening is formed between the doors and the second vertical frame member to allow egress across the doorway between the inside and outside areas. Preferably, the screen panel is adapted to be used in both a right-hand and a left-hand orientation.

DETAILED DESCRIPTION OF THE PREFERRED EMBODIMENTS

Figure 1:
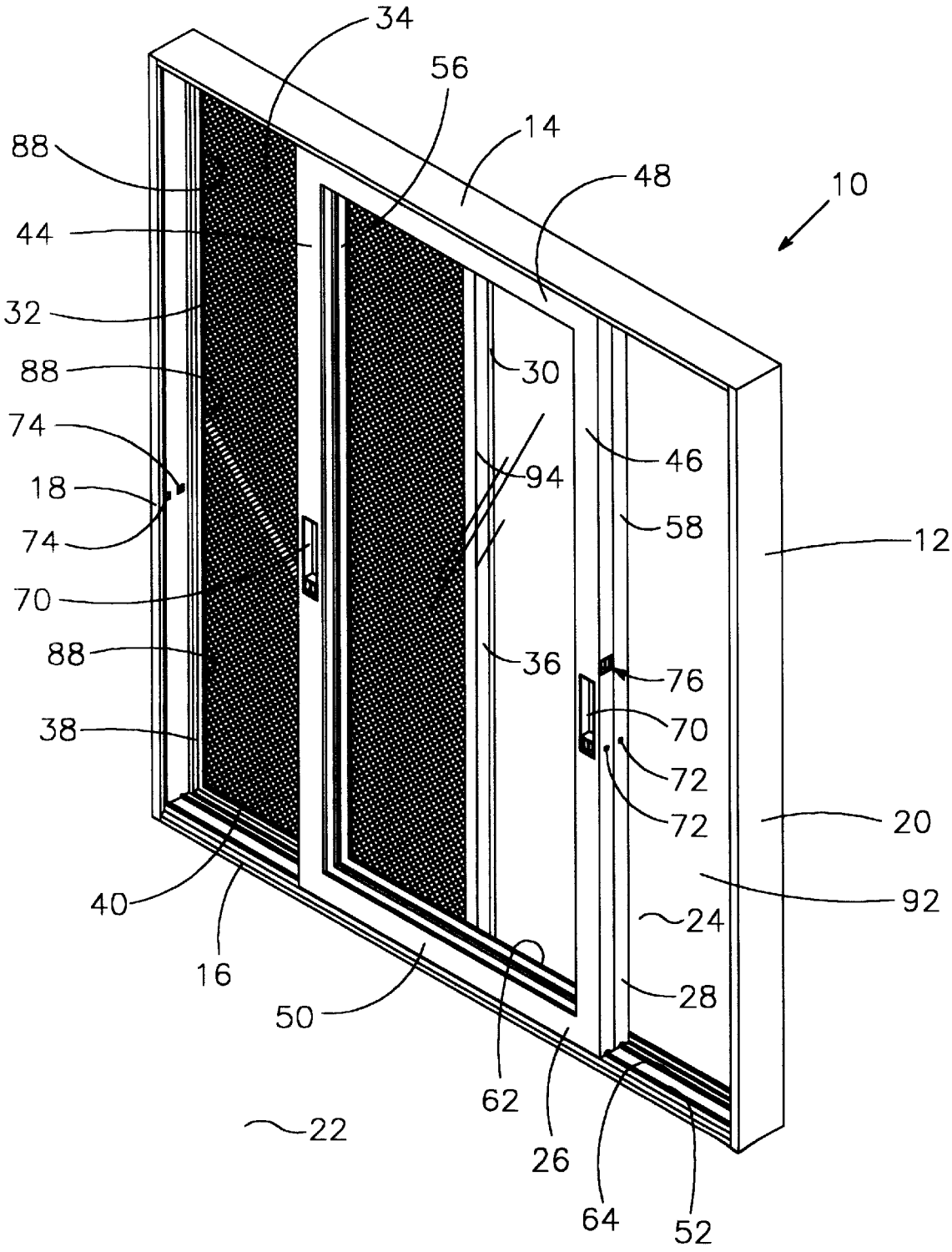
FIG. 1 is a perspective view of a preferred embodiment of the present invention showing the glass doors fastened together and slid partially open.

Shown generally in the figures is a preferred embodiment of a sliding glass door assembly 10 according to the present invention. The door assembly 10 is contained within a standard sliding door doorway formed by a door frame 12. The door frame 12 is a rectangle formed by a top frame member 14, a bottom frame member 16, and first and second vertical frame members 18 and 20. The door frame 12 is generally placed between an inside area 22 and an outside area 24. The sliding glass door assembly 10 has a first sliding glass door 26, a second sliding glass door 28, and a screen panel 30.

Figure 7:
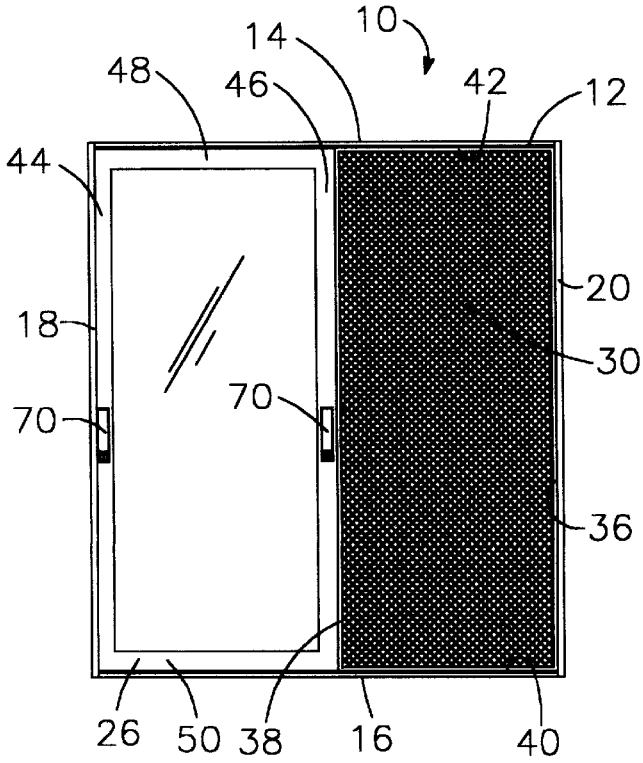
FIG. 7 is a is a front elevation view of a preferred embodiment of the present invention with the screen panel in a right-hand orientation showing the outside door coupled to the inside door with the doors slid to the left side of the doorway to allow ventilation.
Figure 8:
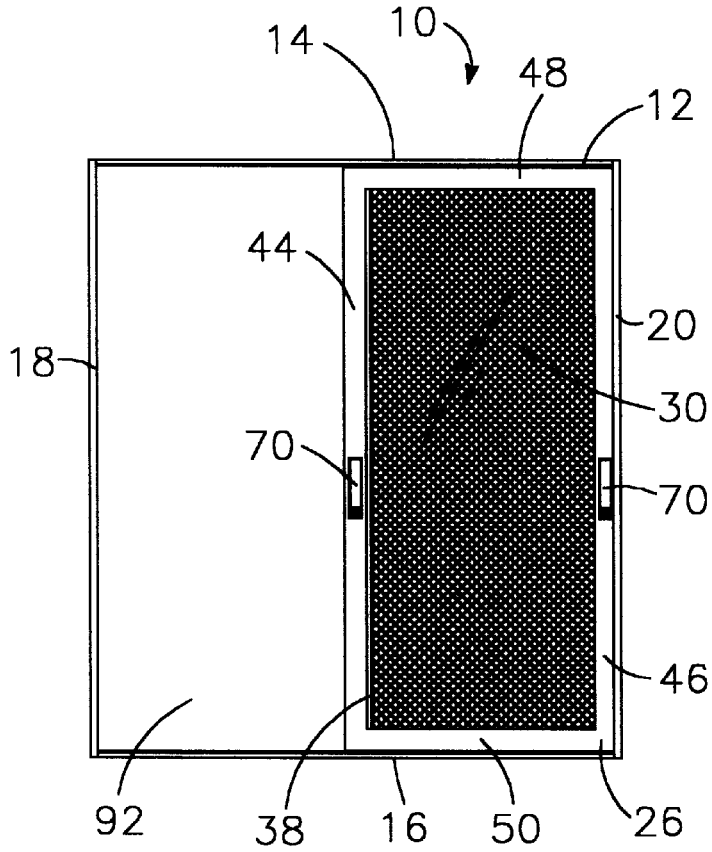
FIG. 8 is a front elevation view of a preferred embodiment of the present invention with the screen panel in a right-hand orientation showing the outside door coupled to the inside door, and both doors slid to the right side of the doorway to allow egress across the doorway.

For the purpose of this description, "left" and "right" will refer to the door frame 12 as viewed from the inside area 22 looking towards the outside area 24. Those of ordinary skill in the art will realize that the glass door assembly 10 could be constructed opposite hand from what is shown in the drawings. The screen panel 30 is formed by a rectangular frame 32 and a screen mesh 34 stretched across the rectangular frame 32. The screen mesh 34 should be sufficiently open to allow ventilation between the inside area 22 and the outside area 24, and should be sufficiently fine to prevent insects and small animals from crossing the doorway. The rectangular frame 32 of the screen panel 30 is formed by a right screen frame member 36, a left screen frame member 38, a bottom screen frame member 40, and a top screen frame member 42. The bottom screen frame member 40 is in engagement with the bottom frame member 16 of the door frame 12. The top screen frame member 42 is in engagement with the top frame member 14 of the door frame 12. The screen panel 30 may be used in a left-hand orientation as shown in FIGS. 1–6, with the left screen frame member 38 in engagement with the left vertical frame member 18 of the door frame 12. The screen panel 30 may also be used in a right-hand orientation as shown in FIGS. 7 and 8, with the right screen frame member 36 in engagement with the right vertical frame member 20 of the door frame 12.

The inside sliding glass door 26 is formed by a rectangular frame having a left frame member 44, a right frame member 46, a top frame member 48, and a bottom frame member 50. A pane of glass is held in sealed engagement with the frame members 44, 46, 48, and 50. The bottom frame member 50 of the inside sliding glass door 26 is adapted to slidably engage a track 52 on the bottom frame member 16 of the door frame 12. Similarly, the top frame member 48 of the inside sliding glass door 26 is adapted to slidably engage track 54 on the top frame member 14 of the door frame 12. Those of ordinary skill in the art will know of other manners to slidably engage the inside glass door 26 with the door frame 12.

The outside sliding glass door 28 is similar to the inside sliding glass door 26. The outside sliding glass door 28 has a left frame member 56, a right frame member 58, a top frame member 60, and a bottom frame member 62. A glass pane is in sealed engagement with the rectangular frame members 56, 58, 60, and 62. The bottom frame member 62 of the outside sliding glass door 28 is adapted for slidable engagement with track 64 in the bottom frame member 16 of the door frame 12. The top frame member 60 of the outside sliding glass door 28 is adapted for slidable engagement with track 66 in the top frame member 14 of the door frame 12.

In the preferred embodiment, each of the sliding glass doors 26 and 28 have a door handle 70 formed in both the left frame member 44, 56 and the right frame member 46, 58. Each of the door handles 70 has associated with it a locking member 72 to lock the sliding glass doors 26, 28 in engagement with the vertical frame members 18, 20 of the door frame 12. As seen FIG. 1, left vertical frame member 18 of the door frame 12 has a lock receiver 74 formed in it to engage the locking member 72. A similar lock receiver is also formed in the right vertical frame member 20 of the door frame 12, but is not shown. Those of ordinary skill in the art will be aware of numerous satisfactory designs for door handles and locks to lock the glass doors 26 and 28 in engagement with the vertical frame members 18 and 20.

Figure 10A:
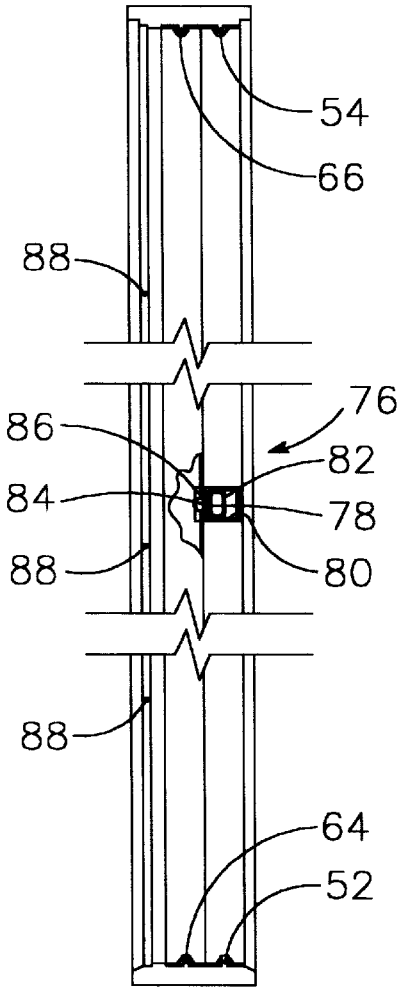
FIG. 10*a* is a detail drawing showing a preferred embodiment of the coupling mechanism used to couple the sliding glass doors together with the coupling member in a coupling position.
Figure 10B:
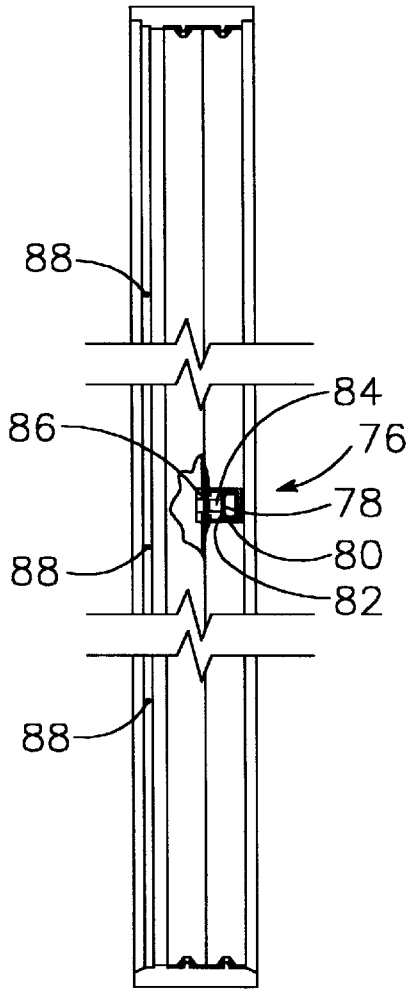
FIG. 10*b* is a detail drawing showing a preferred embodiment of the coupling mechanism used to couple the sliding glass doors together with the coupling member in a retracted position.

The inside sliding glass door 26 is provided with two coupling mechanisms 76 to latch the inside sliding glass door 26 to the outside sliding glass door 28. The coupling mechanisms 76 are provided in the left frame member 44 and right frame member 46 of the inside sliding glass door 26. Detailed views of the coupling mechanism 76 are shown in FIGS. 10*a* and 10*b*. The coupling mechanism 76 comprises a coupling member 78 contained within a passageway 80 within the frame member 44 or 46. The coupling member 78 has a finger ring 82 connected to a coupling rod 84. The coupling member 78 can be adjusted within the passageway 80 such that the coupling rod 84 is either entirely contained within the passageway 80, or such that the coupling rod 84 extends beyond the outside edge of frame member 44 or 46 of the inside sliding glass door 26 (FIG. 10*a*). The left and right frame members 56, 58 of the outside sliding glass door 28 are provided with a receiver bore 86. The receiver bore 86 is of a slightly greater diameter than the diameter of the coupling rod 84 such that the coupling rod 84 may be captured by the receiver bore 86 when the passageway 80 of the coupling mechanism 76 is aligned with the receiver bore 86 and the coupling member 78 is adjusted such that the coupling rod 84 extends beyond the outside edge of the frame members 44 and 46 of the inside sliding glass door 26.

Figure 9A:
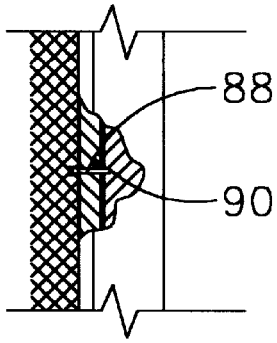
FIG. 9*a* is a detail drawing showing a preferred embodiment for the latching mechanism used to retain the screen panel in connection with the door frame, with the latching mechanism in a released position.
Figure 9B:
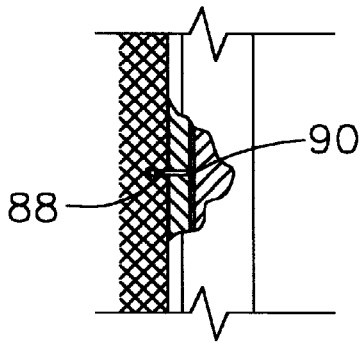
FIG. 9*b* is a detail drawing showing a preferred embodiment for the latching mechanism used to retain the screen panel in connection with the door frame, with the latching mechanism in a locked position.

The screen panel 30 is preferably provided with means for locking the panel 30 in place against either the left vertical frame member 18 or the right vertical frame member 20 of the door frame 12. Those of ordinary skill in the art will be aware of several mechanisms for accomplishing this objective. In the preferred embodiment shown, the rectangular frame 32 of the screen panel 30 is provided with spring loaded pins 88. The spring loaded pins 88 are generally biased so that they extend beyond the edge of the rectangular frame 32. When the screen panel 30 is locked in place in the door frame 12, the spring loaded pins 88 are received within screen locking holes 90 formed in the door frame 12. When it is desired to remove the screen panel 30 from the door frame 12, the spring loaded pins 88 are pulled such that they are retracted within the rectangular frame 32 of the screen panel 30. In the preferred embodiment, a center frame member with a weather strip 94 is also provided to provide additional support for the screen panel 30. With the spring loaded pins 88 retracted into the rectangular frame 32, the screen panel 30 may be removed from the door frame 12 for cleaning or adjustment to the opposite end of the door frame 12. The retracted position is shown in FIG. 9*b*, and the standard biased position is shown in FIG. 9*a*.

FIGS. 1–6 show a preferred embodiment of the present invention with the screen panel 30 in a left-hand orientation, and use of the door assembly 10 with the screen panel 30 in this orientation will be described in detail. FIGS. 7 and 8 show the screen panel 30 in a right-hand orientation. Use of the assembly 10 in this orientation will not be discussed in detail, but should be apparent from the discussion relating to use of the sliding glass door assembly 10 with the screen panel 30 in the left-hand orientation.

Figure 2:
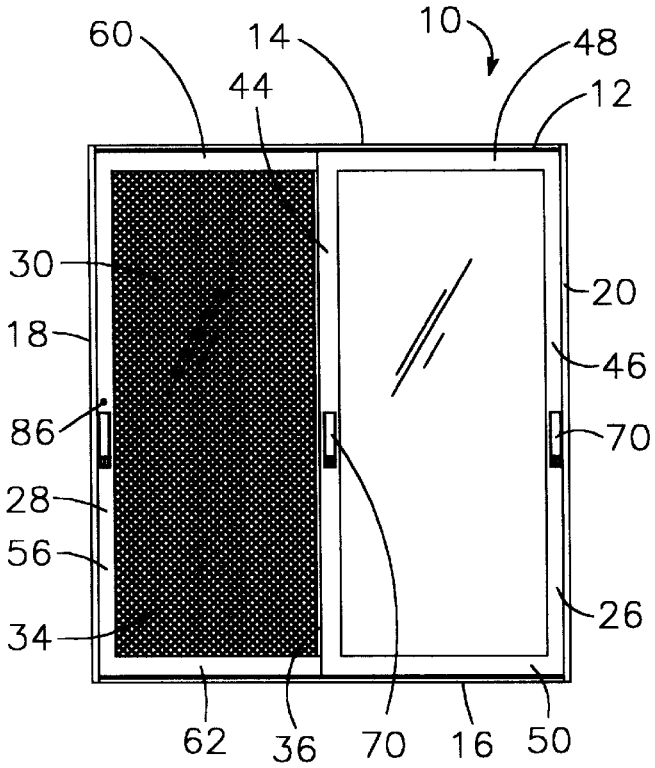
FIG. 2 is a front elevation view of a preferred embodiment of the present invention with the screen panel in a left-hand orientation and the glass doors in a fully closed position.

During times when the inside area 22 is being heated or mechanically cooled, or other times when it is desired to prevent ventilation across the door frame 12, the sliding glass door assembly 10 can be adjusted such that the sliding glass doors 26 and 28 substantially seal the door frame 12. FIG. 2 shows the sliding glass doors 26 and 28 adjusted to completely seal the door frame 12. To lock the sliding glass doors 26 and 28 in the sealed position of FIG. 2, the locking member 72 in the right frame member 46 of the inside sliding glass door 26 is adjusted to engage the lock receiver (not shown) in the right vertical frame member 20 of the door frame 12. The inside sliding glass door 26 is thus prevented from sliding within the door frame 12 by the locking member 72 in engagement the lock receiver. The outside sliding glass door 28 is adjusted so that the left frame member 56 of the outside sliding glass door 28 is in sealed engagement with the left vertical frame member 18 of the door frame 12. In this position, the receiver bore 86 in the right frame member 58 of the outside sliding glass door 28 is aligned with the passageway 80 in the left frame member 44 of the inside sliding glass door 26. The coupling mechanism 76 in the left frame member 44 of the inside sliding glass door 26 may then be adjusted to latch the outside sliding glass door 28 in a fixed relation with the inside sliding glass door 26. This is accomplished by inserting the finger into finger slot 82 and moving the coupling member 78 within the passageway 80 such that coupling rod 84 is extended into the receiver bore 86 of the right frame member 58 of the outside sliding glass door 28. The outside sliding glass door 28 is thusly prevented from sliding within the door frame 12 by the coupling rod 84 received within receiver bore 86. This coupling mechanism 76 further provides a redundant means of locking the inside sliding glass door 26 in addition to the locking member 72 in engagement with the lock receiver 74.

If it is desired to permit ingress or egress across the door frame 12, the inside sliding glass door 26 must be unlocked by adjusting locking member 72 within the right frame member 46 of the inside sliding glass door 26 such that it is out of engagement with the lock receiver in the right vertical frame member 20 of the door frame 12. The coupling mechanism 76 must also be unlatched. This is accomplished by sliding the coupling member 78 within the passageway 80 such that the coupling rod 84 is completely withdrawn into the left frame member 44 of the inside sliding glass door 26, as shown in FIG. 10*b*. The inside glass door 26 may then be slid to the left within the door frame 12 by pulling door handle 70 on the right frame member 46 of the inside sliding glass door 26 away from the right vertical frame member 20 of the door frame 12. (See FIG. 3). This creates an open space 92 through which ingress and egress across the door frame 12 is permitted. It should be appreciated that locking member 72 and lock receiver 74 provide a redundancy with the coupling mechanism 76, and need not be used if it desired to avoid making two adjustments in order to open the sliding glass door 26. It should further be appreciated that unlike conventional assemblies wherein the screen panel must be slid back and forth within the door frame 12 in order to permit ingress and egress across the door frame 12, no adjustment needs to be made to the screen panel 30 of the sliding glass door assembly 10 of the present invention to allow ingress and egress across the door frame 12.

If it is desired to permit ventilation across the door frame 12, the sliding glass door assembly 10 of the present invention can be conveniently adjusted to accomplish this result. Both sliding glass doors 26, 28 are slid so that their right frame members 46, 58 are in sealed engagement with the right vertical frame member 20 of the door frame 12. (See FIG. 4). With both sliding glass doors 26, 28 slid to this rightmost position, the passageway 80 of the coupling mechanism 76 in the left frame member 44 of the inside sliding glass door 26 is in alignment with the receiver bore 86 in the left frame member 56 of the outside sliding glass door 28. The coupling member 78 may then be adjusted within the passageway 80 such that the coupling rod 84 extends into the receiver bore 86, thereby coupling the inside sliding glass door 26 to the outside sliding glass door 28 such that the two doors slide together within the door frame 12 as a unit, as shown in FIG. 10*a*. The sliding glass doors 26, 28 may be locked in this position by adjusting the locking member 72 in the right frame member 46 of the inside sliding glass door 26 into engagement with the lock receiver in the right vertical frame member 20 of the door frame 12. To permit ingress and egress across the door frame 12 with the door assembly 10 in the ventilation arrangement, the locking member 72 is adjusted to unlocked position, and the sliding glass doors 26, 28 are slid to the left away from the right vertical frame member 20 of the door frame 12 by pulling on door handle 70 on the right frame member 46 of the inside sliding glass door 26. (See FIG. 5). It should be appreciated that unlike conventional sliding glass door assemblies, the sliding glass door assembly 10 of the present invention permits ingress and egress across the door frame 12 without adjustment of the screen panel 30.

Figure 3:
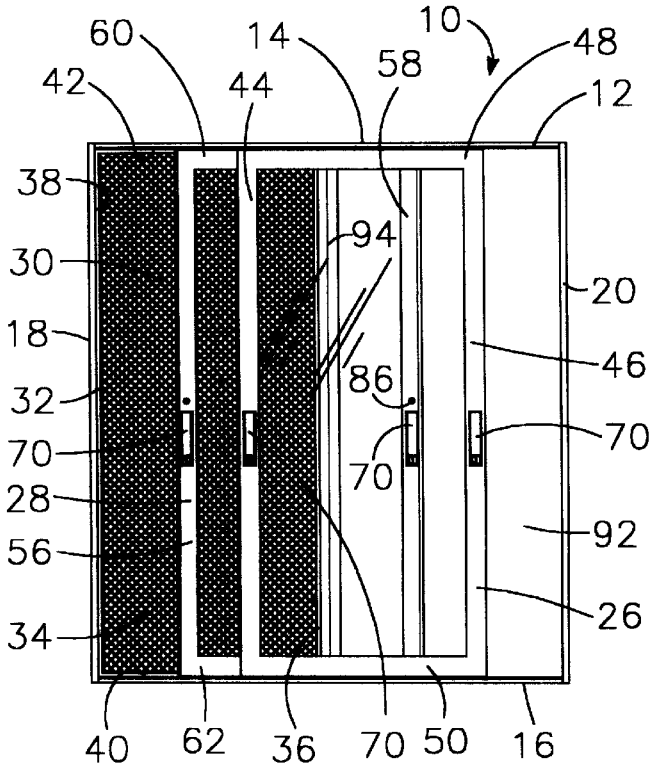
FIG. 3 is a front elevation view of a preferred embodiment of the present invention with the screen panel in a left-hand orientation showing the outside door slid partially open and the inside door slid partially open.
Figure 4:
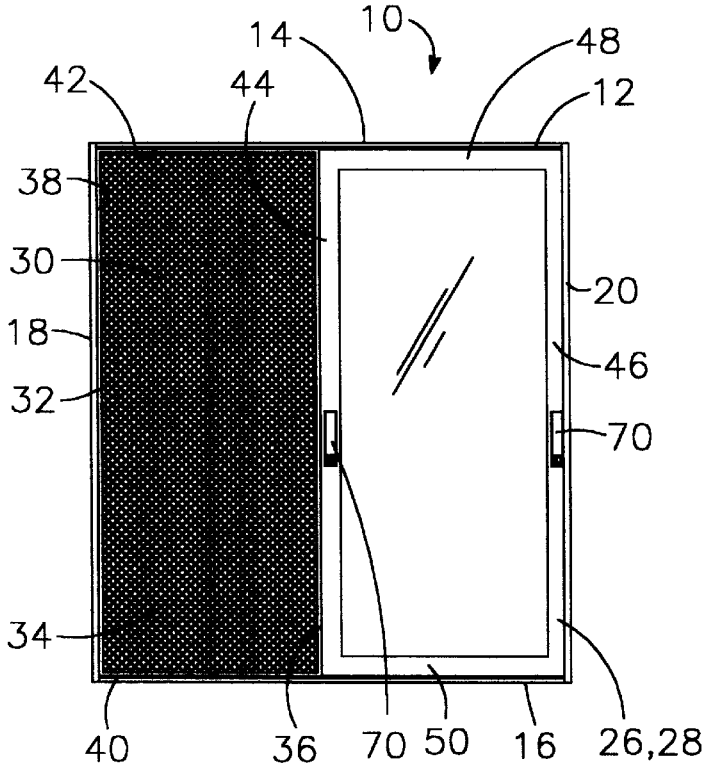
FIG. 4 is a front elevation view of a preferred embodiment of the present invention with the screen panel in a left-hand orientation showing both the outside door and the inside door slid against the right frame member of the doorway to allow ventilation and prevent egress across the doorway.
Figure 5:
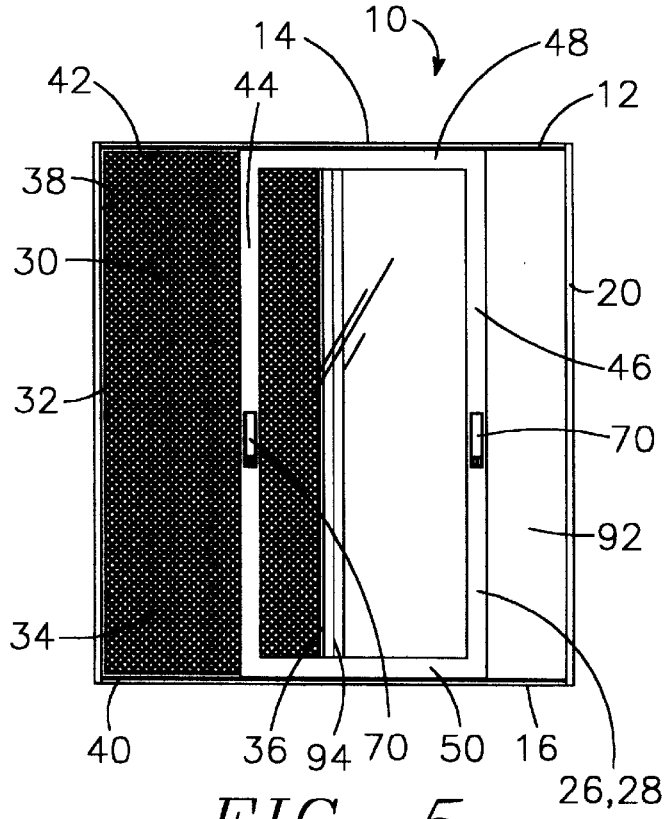
FIG. 5 is a front elevation view of the preferred embodiment of FIG. 1.
Figure 6:
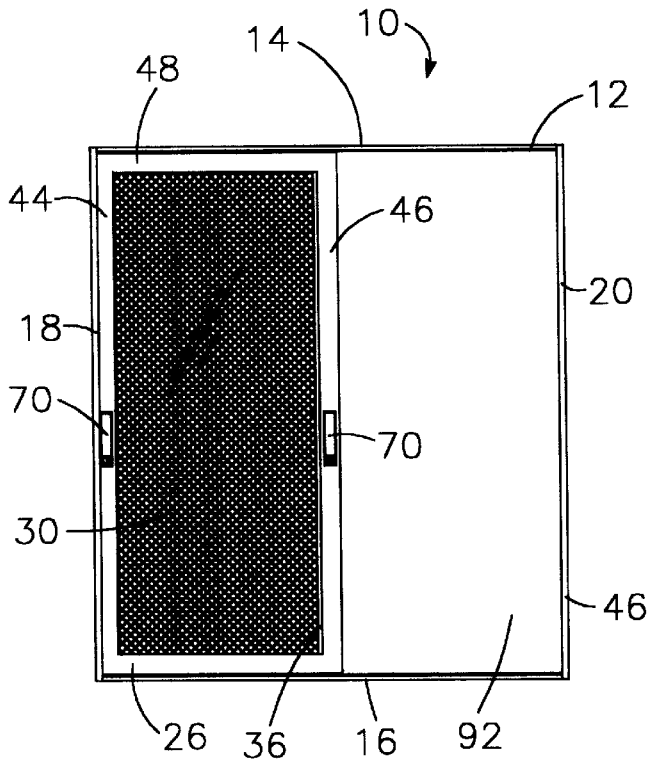
FIG. 6 is a front elevation view of a preferred embodiment of the present invention with the screen panel in a left-hand orientation showing the inside door fastened to the outside door with both doors slid to the left side of the doorway to allow egress across the doorway.

The sliding glass door assembly 10 of the present invention may also be adjusted to allow only partial ventilation across the door frame 12 as shown in FIG. 3. This arrangement is accomplished by uncoupling the inside sliding glass door 26 from the outside sliding glass door 28 so that the sliding glass doors 26, 28 slide separately from each other within the door frame 12. The outside sliding glass door 28 may then be adjusted to an intermediate position such that neither its left frame member 56 nor its right frame member 58 are in contact with the vertical frame members 18 and 20 of the door frame 12. The inside sliding glass door 26 is then slid all the way to the right into sealed engagement with the right vertical frame member 20 to prevent ingress or egress across the door frame 12. Ingress and egress across the door frame 12 may then be permitted by sliding the inside sliding glass door 26 to the left as shown in FIG. 3. Again, it is not necessary to adjust the screen panel 30 in order to achieve this result.

When it is desired to have the screen panel 30 on the right side of the door frame 12, and to allow ingress and egress through the left side of the door frame 12, the screen panel 30 may be removed from the door frame 12 by releasing spring loaded pins 88. The screen panel 30 may then be placed in sealed engagement with the right vertical frame member 20 of the door frame 12, as shown in FIGS. 7 and 8, by aligning the spring loaded pins 88 with the corresponding screen locking holes 90. The sliding door assembly 10 would then work the same as described above, except that the left and right distinctions would be reversed. Providing the door handle 70, the locking member 72, and the coupling mechanism 76 in both the left frame member 44 and the right frame member 46 of the inside sliding glass door 26 allows for this simple reversal of orientation.

It is expected that those skilled in the art will understand that the foregoing description relates merely to preferred embodiments, and that changes and modifications can be made thereto without departing from the scope of the invention as defined in the following claims.

I claim:

1. A sliding door assembly comprising:

a substantially rectangular sliding door doorway, the sliding door doorway having a door frame formed by a lower doorway frame member, an upper doorway frame member, a first vertical doorway frame member, and a second vertical doorway frame member, the sliding door doorway being between an inside area and an outside area;

a first glass door slidably received by the upper and lower doorway frame members, said first glass door having a first rectangular door frame, said first rectangular door frame having a first vertical door frame member and a second vertical door frame member, said first vertical door frame member having a coupling passageway formed therein, said second vertical door frame member having a locking passageway formed therein, said first glass door being adapted to slide to a position wherein said first vertical door frame member is in sealed engagement with said first vertical doorway frame member;

a second glass door slidably received by the upper and lower doorway frame members, said second glass door having a second rectangular door frame, said second rectangular door frame having a third vertical door frame member and a fourth vertical door frame member, said second glass door being adapted to slide to a position wherein said fourth vertical door frame member is in sealed engagement with said second vertical doorway frame member, said second glass door being adapted to slide to a position wherein said first vertical door frame member is in alignment with said third vertical door frame member;

a screen panel operably received by the upper and lower doorway frame members;

a coupling member operably received in said third vertical door frame member such that said coupling member can engage said coupling passageway when said second glass door is in said position wherein said first vertical door frame member is in alignment with said third vertical door frame member to selectively connect said first glass door with said second glass door such that said first and second glass doors are slidable together as a unit in a fixed relation to each other between said first and second vertical doorway frame members, said coupling member further being able to engage said locking passageway when said first glass door is in said position wherein said first vertical door frame member is in sealed engagement with said first vertical doorway frame member and said second glass door is in said position wherein said fourth vertical door frame member is in sealed engagement with said second vertical doorway frame member to lock said glass doors within said sliding door doorway; and means for locking said screen panel against the first vertical doorway frame member such that when said first and second glass doors are slid to engage the second vertical doorway frame member and said screen panel is locked against the first vertical doorway frame member said screen panel in combination with said glass doors prevent egress across the sliding door doorway but still allow ventilation between the inside area and the outside area across said screen panel, such that when said first glass door is in said position wherein said first vertical door frame member is in sealed engagement with said first vertical doorway frame member and said second glass door is in said position wherein said fourth vertical door frame member is in sealed engagement with said second vertical doorway frame member said first and second glass doors substantially prevent ventilation and egress between the inside area and the outside area across the sliding door doorway, and such that when said first and second glass doors and said screen panel engage said first vertical doorway frame member an opening is formed between said first and second glass doors and said second vertical doorway frame member to allow egress across the sliding door doorway between the inside and outside areas.

2. The sliding door assembly according to claim 1, further comprising means for locking said screen panel against the second vertical doorway frame member such that when said first and second glass doors are slid to engage the first vertical doorway frame member and said creen panel is locked against the second vertical doorway frame member, said screen panel in combination with said first and second glass doors prevent egress across the sliding door doorway but still allow ventilation between the inside area and the outside area across said screen panel, and such that when said first and second glass doors and said screen panel engage the second vertical doorway frame member an opening between said first and second glass doors and the first vertical doorway frame member is formed to allow egress across the sliding door doorway between the inside and outside areas.

3. The sliding door assembly according to claim 1, wherein said coupling member is slidably received within a coupling member passageway such that said coupling member is slidable between a retracted position wherein said coupling member is retracted into said coupling member passageway and a coupling position wherein a portion of said coupling member extends beyond an outside surface of said third vertical door frame member.

* * * * *